US005155668A

United States Patent [19]

Tanner et al.

[11] Patent Number: 5,155,668

[45] Date of Patent: Oct. 13, 1992

[54] SOLAR POWERED LAMP UTILIZING COLD CATHODE FLUORESCENT ILLUMINATION AND METHOD OF FACILITATING SAME

[75] Inventors: David P. Tanner, Thousand Oaks; Mark R. Erickson, Oxnard; John S. Frost, Thousand Oaks, all of Calif.

[73] Assignee: Siemens Solar Industries L.P., Camarillo, Calif.

[21] Appl. No.: 666,757

[22] Filed: Mar. 8, 1991

[51] Int. Cl.[5] ..... F21L 11/00

[52] U.S. Cl. ..... 362/183; 362/186; 362/191; 362/222; 362/276; 315/149; 315/DIG. 7

[58] Field of Search ..... 362/183, 186, 191, 221, 362/222, 276, 263, 265, 363, 431, 802, 260; 315/149, DIG. 5, DIG. 7

[56] References Cited

U.S. PATENT DOCUMENTS

| | | | |
|---|---|---|---|
| 3,833,804 | 9/1974 | Vesely | 362/291 |
| 4,319,310 | 3/1982 | Kingsley | 362/183 |
| 4,410,930 | 10/1983 | Yachabach | 362/183 X |
| 4,682,078 | 7/1987 | Pascalide | 362/183 X |
| 4,774,648 | 9/1988 | Kakuk et al. | 362/302 |
| 4,835,664 | 5/1989 | Wen | 362/183 |
| 4,841,416 | 6/1989 | Doss | 362/183 |

*Primary Examiner*—Stephen F. Husar
*Attorney, Agent, or Firm*—Nilsson, Wurst & Green

[57] ABSTRACT

A solar powered lamp utilizing cold cathode fluorescent illumination and means for facilitating same. The solar powered lamp is powered through the utilization of photovoltaic cells which charge a battery for providing power to a cold cathode fluorescent bulb in the absence of sunlight. The cold cathode fluorescent bulb provides increased illumination and a longer lamp life. The solar powered lamp comprises circuitry for converting the low power provided by the battery into an alternating current voltage sufficient to operate the cold cathode fluorescent bulb in order to facilitate a longer lamp life and provide increased illumination. In a preferred embodiment, a lens configured with vertically disposed ribs about its inner surface is disposed about the cold cathode fluorescent lamp, which is vertically disposed within the lamp, to further enhance illumination.

16 Claims, 2 Drawing Sheets

SOLAR POWERED LAMP UTILIZING COLD CATHODE FLUORESCENT ILLUMINATION AND METHOD OF FACILITATING SAME

FIELD OF THE INVENTION

This invention relates generally to self-contained solar powered illumination devices and, more particularly, to utilization of fluorescent bulbs for providing increased illumination in such solar powered illumination devices. More specifically, the invention relates to utilization of cold cathode fluorescent bulbs in solar powered lamps to provide increased illumination and enhance lamp life and means for facilitating same.

BACKGROUND OF THE INVENTION

Electrically powered outdoor illumination devices are widely used to illuminate pathways, yards, parks and other like areas. Commonly, such illumination devices are connected to public utility systems, or similar sources of electrical power and are controlled by preset timing devices, to illuminate desired areas at nightfall and automatically turn off at a predetermined time, for example, prior to daybreak.

Many traditional illumination devices require extensive cabling, suitable timing mechanisms and the like, and are thus relatively expensive to install and maintain. Moreover, such illumination devices utilize electric power generated in a conventional manner such as by burning fuel. Burning fuel contributes to contamination of the environment and depletion of existing fuel resources.

More recently, self-contained solar powered illumination devices which utilize photovoltaic devices to charge batteries which, in turn, activate a light source contained therein, in the absence of sunlight, have been used for illumination and/or decorative purposes. Such self-contained devices have limited battery power and thus, typically utilize low wattage bulbs, particularly incandescent bulbs which do not generate sufficient light to provide clear illumination in the areas desired. Use of incandescent bulbs provide a low level of light and render such self-contained illumination devices particularly impractical for security applications or the like. Alternatively, if sufficient illumination is provided, the battery power is insufficient to maintain the illumination for the time desired.

Fluorescent lamps are widely used to provide illumination in traditional electrically powered illumination devices used for general lighting purposes because they are more efficient than incandescent bulbs in generating light. A fluorescent lamp is a low-pressure gas discharge source, in which light is produced predominantly by fluorescent powders activated by ultraviolet energy generated by a mercury plasma forming an arc. The lamp, usually in the form of a tubular bulb with an electrode sealed into each end, contains mercury vapor at low pressure with a small amount of inert gas for starting. The inner walls of the bulb are coated with fluorescent powders commonly called phosphors. When the proper voltage is applied, the plasma (forming an arc) is produced by current flowing between the electrodes through the mercury vapor. This discharge generates some visible radiation. The ultraviolet in turn excites the phosphors to emit light.

Two electrodes are hermetically sealed into the bulb, one at each end. These electrodes are designed for operation as either "cold" or "hot" cathodes or electrodes, more correctly called glow or arc modes of discharge operation. Electrodes for glow or cold cathode operation may consist of closed-end metal cylinders, generally coated on the inside with an emissive material. Conventional cold cathode lamps operate at a current order of a few hundred milliamperes, with a high cathode fall or voltage drop, something in excess of 50 volts.

The arc mode or hot cathode electrode is generally constructed from a tungsten wire or a tungsten wire around which another very fine tungsten wire has been uniformly wound. The larger tungsten wire is coiled producing a triple coil electrode. When the fine wire is absent, the electrode is referred to as a coiled-coil electrode. This coiled-coil or triple-coiled tungsten wire is coated with a mixture of alkaline earth oxides to enhance electron emission. During lamp operation, the coil and coating reach temperatures of about 1100° C. where the coil/coating combination thermally emits large quantities of electrons at a low cathode fall of the order of 10 to 12 volts. The normal operating current of hot cathode lamps presently ranges upwards to 1.5 amperes. As a consequence of the lower cathode fall associated with the "hot" cathode, more efficient lamp operation is obtained and, therefore, most fluorescent lamps are designed for "hot" cathode operation.

The lamp life of hot cathode lamps is determined by the rate of loss of the electron emissive coating on the electrodes. Some of the coating is eroded from filaments each time the lamp is started. Also, during lamp operation evaporation of emissive material occurs. Although electrodes are designed to minimize both of these effects, the end of the lamp life is reached when either the coating is completely removed from one or both electrodes or the remaining coating becomes non-emissive. Because some of the emissive coating is lost from the electrodes during each start, the frequency of starting hot cathode lamps influences their life. The rated average life of hot cathode fluorescent lamps is usually based on three hours of operation per start.

Cold cathode lamps on the contrary are not appreciably affected by starting frequency because of the type of electrode used. Cold cathode fluorescent lamps emit light in the same way as do standard hot electrode lamps. These operate as normal glow discharges and their electrodes are uncoated hollow cylinders of nickel or iron. The cathode fall is high and to obtain high efficacy or power for general lighting purposes, conventional lamps are made fairly long, about 3 m, with a diameter of about 20 mm or 25 mm. About 2000 V is required for starting these conventional lamps, and about 900 V to 1000 V for running.

The advantages of cold electrode lamps compared with the hot electrode lamps are that they have a very long life, usually 15000 hours or more, in consequence of their rugged electrodes and low current consumption. They start immediately, even under cold ambient conditions. Their life is unaffected by the number of starts. Also, they may be dimmed to very low levels of light output.

Some self-contained lamps have utilized hot cathode fluorescent bulbs in an effort to provide increased illumination. Such lamps have used a simple circuit including a transformer with a single transistor to generate a square wave. However, this has resulted in a substantially decreased lamp life and high current consumption. A square wave degenerates the characteristics of the hot cathode fluorescent bulb. In addition, a major disadvantage of using hot cathode fluorescent bulbs in self-contained lamps lies in their inability to function properly at low ambient temperatures.

SUMMARY OF THE INVENTION

The present invention provides a solar powered lamp utilizing cold cathode fluorescent illumination and means for facilitating same. The solar powered lamp of the present invention is powered through the utilization of photovoltaic cells (otherwise referred to as a solar cell array) which charge an electrical storage device, such as a battery for providing power to a cold cathode fluorescent bulb, in the absence of sunlight. The cold cathode fluorescent bulb provides increased illumination and a longer lamp life.

In one aspect of the present invention, the solar powered lamp comprises a circuit for converting the low power provided by the battery into an alternating current to operate the cold cathode fluorescent bulb in order to facilitate a longer lamp life and provide increased illumination. In one embodiment, this circuit comprises a resonant invertor circuit for converting a low voltage of approximately 2.5 volts DC provided by the battery into a high voltage of approximately 170–180 volts AC.

In another aspect of the present invention, a lens configured with vertically disposed ribs about its inner surface is utilized in conjunction with the cold cathode fluorescent bulb which is vertically disposed within the lamp to further enhance illumination.

These as well as other features of the invention will become apparent from the detailed description which follows, considered together with the appended drawings.

BRIEF DESCRIPTION OF THE DRAWINGS

A preferred embodiment of the present invention is illustrated in and by the following drawings in which like reference numerals indicate like parts and in which.

DETAILED DESCRIPTION OF THE PREFERRED EMBODIMENT

Figure 1:
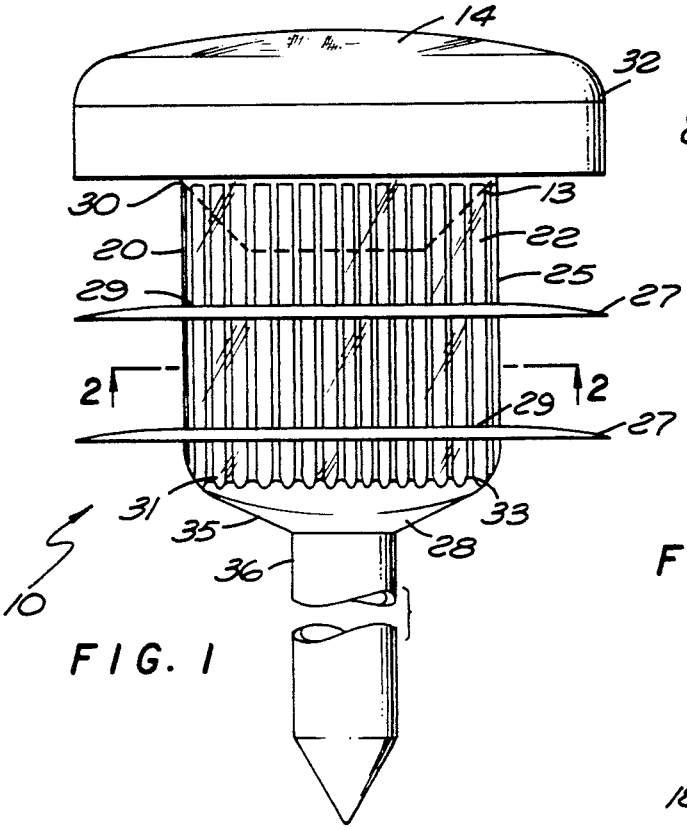
FIG. 1 is an elevational view showing an exemplary solar powered lamp utilizing a lens of the present invention configured to enhance illumination.

FIG. 1 illustrates generally a solar powered lamp 10 utilizing cold cathode fluorescent illumination in accordance with the present invention. The solar powered lamp 10 may be positioned at any desired location for any desired application. The embodiment illustrated herein merely exemplifies the invention, which may take forms different from the specific embodiment disclosed. The solar powered lamp 10 in accordance with the present invention advantageously provides increased illumination and longer lamp life than conventional lamps.

Figure 3:
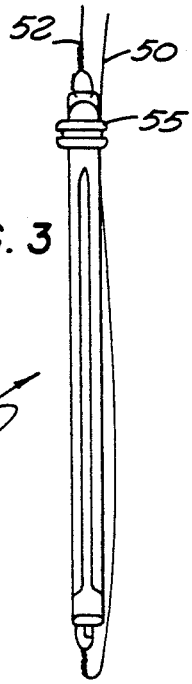
FIG. 3 is an elevational view of a cold cathode fluorescent bulb used in the solar powered lamp shown in FIG. 1.

The solar powered lamp 10 includes a self-contained electrical storage device, such as a battery 12 (shown in FIGS. 4 and 5), of conventional design (preferably Nickel-Cadmium or the like), which is maintained in a charged condition by a solar cell array 14 and includes an electrical circuit 16 (shown in FIGS. 4 and 5) which controls the application of electrical power to a cold cathode fluorescent bulb 18 (shown in FIGS. 3 and 5) vertically contained therein. The electrical power from the battery 12 is supplied to the cold cathode fluorescent light bulb 18 when the solar cell array 14 is not producing electricity, that is, when the ambient light falls below a predetermined level and there is insufficient sunlight.

The cold cathode fluorescent bulb 18 advantageously provides increased illumination, approximately up to five times more than incandescent bulbs, conventionally used in solar powered lamps. In addition, cold cathode fluorescent bulbs greatly extend the lamp life in contrast to hot cathode fluorescent bulbs.

Figure 2:
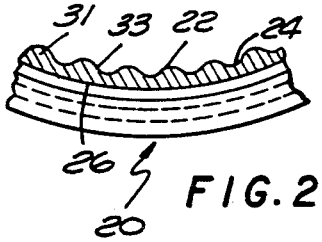
FIG. 2 is a cross-sectional view taken along line 2—2 of FIG. 1 clearly illustrating the vertical ribs formed in an inner surface of the lens.

Referring now to FIGS. 1 and 2, in a preferred embodiment, a lens 20 having a hollow cylindrical portion 25 closed at its lower end 28 is disposed about the cold cathode fluorescent bulb 18. The cylindrical portion 25 is configured with vertical ribs 22 formed on its inner surface 24 such that the light striking the ribs 22 diffuses and presents a glowing effect which further enhances illumination as well as contributes to the aesthetic appearance of the lamp 10. The lens 20 efficiently utilizes the light available from the cold cathode fluorescent bulb 18.

Preferably, the lens 20 is constructed from any translucent material, such as molded polypropylene which has translucent characteristics and is impact resistant. The translucent nature of the material provides a more soft appearance and improves the aesthetic appearance of the lamp.

As shown clearly in FIG. 2, the lens 20 has a smooth outer surface 26 and an inner surface 24 which is provided with a plurality of the vertical ribs 22 disposed in close proximity so as to appear corrugated. The lens 20 has decorative disks 27 which have a curved fin-like configuration retained upon its outer surface 26. The vertical ribs 22 are alternating convex surfaces 31 and concave surfaces 33. The convex surfaces 31 are spaced apart by the concave surfaces 33 having any suitable width desired by those skilled in the art. Each of the vertical ribs 22 has any suitable thickness desired by those skilled in the art. The vertical ribs 22 may extend continuously along their vertical axes or may be segmented or broken at locations 29 on the inner surface 24 corresponding to the decorative disks 27. As is clearly illustrated in FIG. 1, the vertical ribs 22 formed by the convex and concave surfaces extend vertically across the lens and terminate at the lower end 28 of the lens 20.

The lower end 28 of the lens has an angled base 35. The lower end 28 of the lens is clear and unobstructed, that is there are no vertical ribs 22 formed in the lower end 28. Light which is directed downwardly, passes through the lower end 28 and illuminates the areas surrounding the lamp in an efficient manner.

The hollow cylindrical portion 25 of the lens 20, at its open upper end 30, has a plurality of lugs extending therefrom (not shown). These lugs are utilized to receive and secure in position a cover 32 to close the open upper end 30 of the lens 20. Cooperative securing means (not shown), known to those skilled in the art are provided internally of the cover 32 for receiving the lugs.

Positioned internally within the cover are the photovoltaic cells or the solar cell array 14 which when exposed to sunlight, provides electrical energy to charge the battery 12 that provides the electrical energy to power the cold cathode fluorescent bulb 18.

The lower portion 28 of the lens 20 includes a protrusion (not shown) extending therefrom which is configured to receive a stake 36 which is securely mounted upon the protrusion. The stake 36 is utilized to place the lamp 10 at any desired position for illumination of any desired area.

Figure 4:
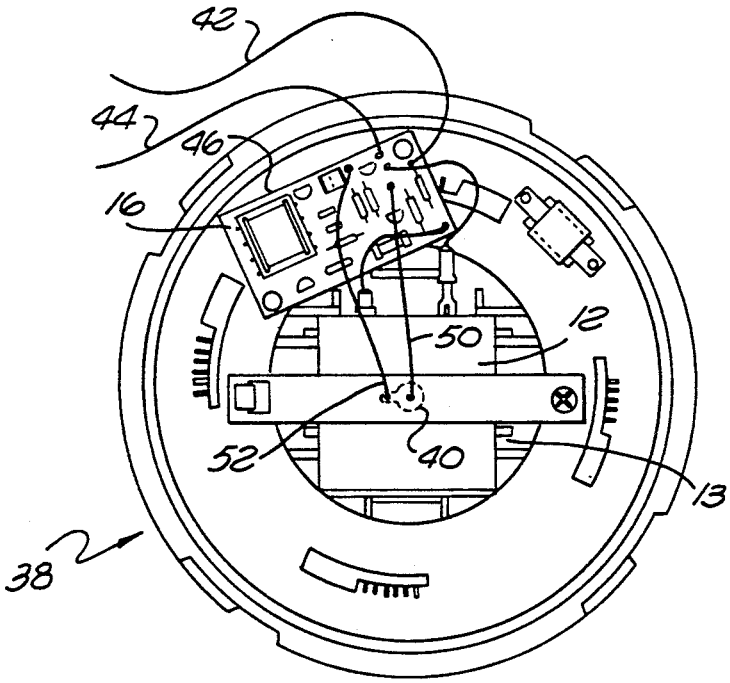
FIG. 4 is a top plan view of a component tray of the solar powered lamp illustrating a battery and a circuit board thereof.

As shown in FIG. 4, a component tray 38 is provided to receive the battery 12 and electrical circuit 16 and cold cathode fluorescent light bulb 18 disposed in a central aperture 40 (shown in broken lines). The battery 12 and other components of the solar powered lamp 10 may be arranged in any desired manner. The components as arranged in FIG. 4 should only be construed as an exemplary illustration. The component tray 38 is interconnected by electrical wires 42 and 44 to the solar cell assembly 14 (shown in FIG. 1) so that electrical power may be provided from the solar cell array 14 to the battery 12 to maintain the same in a charged condition. The battery 12 also through the provision of the electrical circuit 16 provides electrical power to the cold cathode fluorescent bulb 18, when the solar cell array 14 is not generating electrical energy.

The battery 12 is supported within any suitable battery container compartment, indicated at 13. Attached to the compartment are appropriate contacts to receive electrical wires connecting to a circuit board 46 which contains the electrical circuit 16 to control the application of power to the battery 12 for charging, or from the battery 12 to the cold cathode fluorescent bulb 18 to illuminate the same. The circuit board 46 may simply be pressed into place and held by any suitable retainer (not shown). Appropriate electrical leads 50 and 52 extend from the circuit board 46 to the cold cathode fluorescent bulb 18 which is appropriately supported within the aperture 40 by a suitable clamp 55 (shown in FIG. 3). In a preferred embodiment, the cold cathode fluorescent bulb 18, of conventional design, is suitably sized in length and diameter. The cold cathode fluorescent bulb 18 is preferably about 3 inches in length and approximately 4 millimeters in diameter. The cold cathode fluorescent bulb 18 is of a type commercially available for use in LCD's (Liquid Crystal Display).

Figure 5:
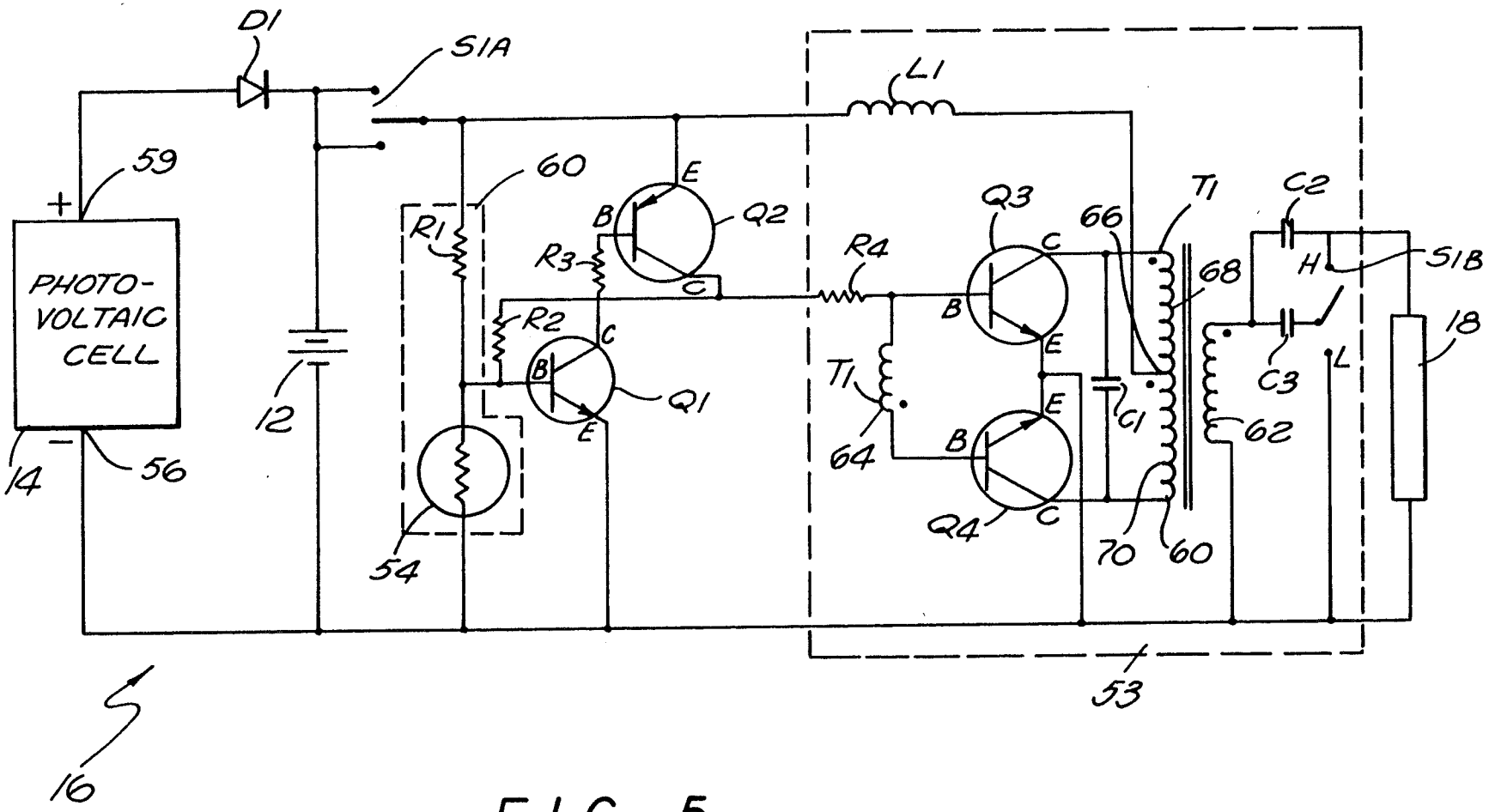
FIG. 5 is a schematic diagram of the circuitry of the present invention used in the solar powered lamp to facilitate use of the cold cathode florescent lamp.

Referring now to FIG. 5, the electrical circuit 16 which provides power to the cold cathode fluorescent bulb 18, includes circuitry 53 for converting the low voltage of approximately 2.5 volts DC provided by the battery 12 into an alternating current approximately in the range of 170–180 volts AC for operating the cold cathode fluorescent lamp 18.

The electrical circuit 16 includes a light sensor 54, preferably a cadmium sulfide cell, which has a resistance which decreases in the presence of light. Upon sensing light, the resistance of the light sensor 54 drops to a level which maintains a first transistor Q1 in its off condition, even when a switch S1A is closed connecting the battery 12 thereacross. A diode D1, preferably a 1N5817 diode, known to those skilled in the art, is electrically connected to a positive terminal 59 of the photovoltaic cell 14.

In the absence of light, when the switch S1A is closed, the voltage across the light sensor 54 increases and a voltage divider 60 comprising a resistor R1 and the light sensor 54 creates a voltage drop across the light sensor 54, causing transistor Q1 to turn on by biasing the base positive with respect to the emitter. The transistor Q1 is preferably a 2N3904 transistor, known to those skilled in the art. The resistor R1 preferably has an exemplary resistance of 28 K ohms.

As the transistor Q1 turns on, current is also drawn through a second transistor Q2. The collector of transistor Q2 is electrically connected to the base of transistor Q1, providing a current feedback through the collector of transistor Q2 and the emitter of transistor Q1 back to a negative terminal 56 of the battery 12 to cause the circuit to turn on immediately.

A resistor R2 is electrically connected between the collector of the transistor Q2 and the base of transistor Q1 to limit the flow of current. Also, a resistor R3 is electrically connected between the base of transistor Q2 and the collector of transistor Q1 to limit current flow. Exemplary resistance values for resistors R2 and R3 are 24 K ohms and 2.2 K ohms, respectively Transistor Q2 is preferably a 2N3906 transistor, known to those skilled in the art.

The collector of transistor Q2 is also electrically connected to the base of transistors Q3 and Q4 which positively biases each of those transistors causing them to start conducting. A resistor R4 for limiting current flow is electrically connected between the collector of transistor Q2 and the base of transistor Q3. An exemplary resistance value for the resistor R4 is 330 ohms. Transistors Q3 and Q4 are 2N4401 transistors, known to those skilled in the art.

A transformer T1 having a primary winding 60, a secondary winding 62 and a tertiary or feedback winding 64 is electrically connected to transistors Q3 and Q4. Transistors Q3 and Q4 act as switches alternately connecting the low voltage of approximately 2.5 volts DC across the primary winding 60.

The feedback winding 64 is arranged in such a way that the base of the conducting transistor is negative whereas the base of the non-conducting transistor is positive. The feedback winding 64 is electrically connected between the bases of transistors Q3 and Q4, as a result of which one of the transistors Q3 and Q4 conducts more than the other. If transistor Q3 is conducting, the feedback winding 64 electrically connected thereto more positively biases transistor Q3 with respect to transistor Q4, causing transistor Q3 to turn on fully and transistor Q4 to turn off. When transistor Q3 is conducting, current flows from the battery 12 through an inductor L1 to a center tap 66 of the primary winding 60, through an upper half 68 of the primary winding 60. The current flows through the transistor Q3 from the collector to the emitter and returns to the negative terminal 56 of the battery 12.

The flow of current along this path continues until the transformer T1 begins to saturate and the polarity of the feedback winding 64 between the bases of transistors Q3 and Q4 is reversed. Transistor Q3 is turned off and transistor Q4 starts conducting thus creating flow in the opposite direction through transistor Q4.

When transistor Q4 is conductinq, current flows from the battery 12 through the inductor L1 to the center tap 66 of the primary winding 60, through a lower half 70 of the primary winding 60. The current flows through the transistor Q4 from the collector to the emitter and returns to the negative terminal 56 of the battery 12.

This switching continues in the manner described above to convert the low voltage of approximately 2.5 volts DC provided by the battery to approximately 170 to 180 volts alternating current. A capacitor C1 connected in parallel with the primary winding 60 of the transformer T1 produces a parallel resonant LC circuit which helps control the frequency of oscillation which is approximately 30,000 Hz.

A square wave used commonly with hot cathode fluorescent lamps, would destroy the characteristics of the cold cathode lamp and degenerate its lifetime considerably. The inductor L1 together with the transformer T1 creates a resonant invertor circuit which provides a sine wave output voltage. The inductor L1 builds charge when the current flows through at a given direction, and when flow reverses, discharges back through the transformer T1 to aid in generating a sine wave. The inductor L1, of conventional design, preferably has 84 turns. The transformer T1, also of a type known to those skilled in the art, has 12 turns in its primary winding 60, 6 turns in its feedback winding 64 and 638 turns in its secondary winding 62. The saturation characteristics of the transformer T1 cause the switching to occur.

A capacitor C2 electrically connected between the secondary winding 62 of the transformer T1 and a switch S1B connected across the cold cathode lamp 18 is the series output capacitor. The switch S1B is any three way switch indicating a "High," a "Low" and an "off" position. The capacitor C2 controls the output impedance of the circuit and limits the amount of current flow through the cold cathode lamp 18.

A capacitor C3 electrically connected in parallel with the capacitor C2 increases the lamp current and decreases the output impedance, when the switch S1B is in the "High" position. When the switch S1B is in the "Low" position, the lamp current decreases by shunting the output winding and returning output power to the circuit.

The 170 to 180 volts alternating current generated supplies power for heating the electrodes of the cold cathode fluorescent lamp 18 and creating a discharge within the cold cathode florescent lamp 18. This sine wave enhances and extends the life of the cold cathode fluorescent lamp 18 in contrast with a low voltage square wave which would degenerate the characteristics of the cold cathode fluorescent lamp 18.

Although the invention has been described in terms of a preferred embodiment thereof, other embodiments that are apparent to those of ordinary skill in the art are also within the scope of the invention. Accordingly, the scope of the invention is intended to be defined only by reference to the appended claims.

What is claimed is:

1. A solar powered lamp for providing increased illumination and extended lamp life, comprising:

a photovoltaic cell receiving sunlight and generating electrical energy;

an electrical storage device coupled to said photovoltaic cell, said photovoltaic cell transferring said electrical energy to said electrical storage device, said electrical storage device providing low voltage direct current; and means for generating a higher voltage alternating current from said low voltage direct current to illuminate a cold cathode fluorescent bulb, when ambient light is absent.

2. A solar powered lamp for providing increased illumination and extended lamp life as defined in claim 1, wherein said cold cathode lamp is disposed along a vertical axis in said solar powered lamp.

3. A solar powered lamp for providing increased illumination and extended lamp life as defined in claim 2, further comprising:

a lens disposed about said cold cathode fluorescent lamp, said lens having a plurality of spaced vertically disposed ribs formed on an inner surface, said ribs having alternating convex and concave surfaces to diffuse light falling thereon.

4. A solar powered lamp for providing increased illumination and extended lamp life as defined in claim 3, wherein said lens is formed from a translucent material.

5. A solar powered lamp for providing increased illumination and extended lamp life as defined in claim 1, wherein said electrical storage device provides a low voltage direct current of 2.5 volts DC.

6. A solar powered lamp for providing increased illumination and extended lamp life as defined in claim 1, wherein said higher voltage alternating current is in a range from 170 volts AC to 180 volts AC.

7. A solar powered lamp for providing increased illumination and extended lamp life as defined in claim 1, further comprising:

a light sensor, said light sensor having a resistance, said resistance decreasing when said light sensor detects light.

8. A solar powered lamp for providing increased illumination and extended lamp life as defined in claim 7, wherein said resistance increases when said light sensor does not detect light.

9. A solar powered lamp for providing increased illumination and extended lamp life as defined in claim 8, further comprising:

means for conducting current, said conducting means electrically connected to said light sensor, said conducting means activated by a voltage drop across said light sensor.

10. A solar powered lamp for providing increased illumination and extended lamp life as defined in claim 9, wherein said generating means is electrically connected to said conducting means, said conducting means providing low voltage direct current to said generating means.

11. A solar powered lamp for providing increased illumination and extended lamp life as defined in claim 1, wherein said generating means comprises:

a transformer having primary, secondary and feedback windings;

first and second transistors having a collector, base and emitter, said first and second transistors electrically connected to said transformer, said feedback winding of said transformer electrically connected between said bases of said first and second transistors; and an inductor electrically connected between said primary winding of said transformer and said electrical storage device, said primary winding electrically connected to said collectors of each of said first and second transistors.

12. A solar powered lamp for providing increased illumination and extended lamp life as defined in claim 11, wherein said emitter of said first transistor is electrically connected to said emitter of said second transistor, said emitters of each of said first and second transistors electrically connected to a negative terminal of said battery.

13. A circuit for converting a low voltage direct current provided by a battery to a high voltage alternating current in a solar powered lamp, comprising:

a resonant invertor circuit for converting a low voltage direct current to a high voltage alternating current to illuminate a cold cathode fluorescent bulb disposed within said solar powered lamp when ambient light is absent, said resonant invertor circuit further comprising:

a transformer having primary, secondary and feedback windings;

first and second transistors having a collector, base and emitter, said first and second transistors electrically connected to said transformer, said feedback winding of said transformer electrically connected between said bases of said first and second transistors; and an inductor electrically connected between said primary winding of said transformer and said battery, said primary winding electrically connected to said collectors of each of said first and second transistors.

14. A circuit for converting a low voltage direct current provided by a battery to a high voltage alternating current in a solar powered lamp as defined in claim 13, wherein said emitter of said first transistor is electrically connected to said emitter of said second transistor, said emitters of each of said first and second transistors electrically connected to a negative terminal of said battery.

15. A solar powered lamp for providing increased illumination and extended lamp life, comprising:

a photovoltaic cell receiving sunlight and generating electrical energy;

an electrical storage device coupled to said photovoltaic cell, said photovoltaic cell transferring said electrical energy to said electrical storage device, said electrical storage device providing low voltage direct current; and a generator circuit coupled to said electrical storage device and generating a higher voltage alternating current from said low voltage direct current to illuminate a cold cathode fluorescent bulb in the absence of ambient light.

16. A method for providing increased illumination and extended lamp life in a solar powered lamp, comprising the steps of:

receiving sunlight and utilizing a photovoltaic cell to generate electrical energy;

coupling an electrical storage device to said photovoltaic cell;

transferring said electrical energy to said electrical storage device;

providing low voltage direct current from said electrical storage device; and generating a higher voltage alternating current from said low voltage direct current to illuminate a cold cathode fluorescent bulb in the absence of ambient light.

* * * * *

UNITED STATES PATENT AND TRADEMARK OFFICE

CERTIFICATE OF CORRECTION

PATENT NO. : 5,155,668

DATED : October 13, 1992

INVENTOR(S) : David P. Tanner, et al.

It is certified that error appears in the above-identified patent and that said Letters Patent is hereby corrected as shown below:

| Column | Line | |
|---|---|---|
| 6 | 19 | after "respectively" insert a period. |
| 7 | 25 | change "S1B" to --S1b--. |

Signed and Sealed this

Twenty-eighth Day of September, 1993

Bruce Lehman

*Attest:*

BRUCE LEHMAN

*Attesting Officer*

*Commissioner of Patents and Trademarks*